US005282615A

United States Patent [19]

Green et al.

[11] Patent Number: 5,282,615

[45] Date of Patent: Feb. 1, 1994

[54] TETHERED-BALL, HITTING PRACTICE APPARATUS

[76] Inventors: Bill D. Green, 6513 Hinkle Dr., Harrison, Tenn. 37341; Joe B. Johnson, 4291 Highwood Dr., Chattanooga, Tenn. 37415

[21] Appl. No.: 986,587

[22] Filed: Dec. 7, 1992

[51] Int. Cl.[5] ..... A63B 69/40

[52] U.S. Cl. ..... 273/26 E; 273/29 A

[58] Field of Search ..... 273/26 E, 29 A, 58 C, 273/30

[56] References Cited

U.S. PATENT DOCUMENTS

| | | | |
|---|---|---|---|
| 2,219,732 | 10/1940 | Armstrong | 273/26 E |
| 3,853,316 | 12/1974 | Smith | 273/30 |
| 3,893,669 | 7/1975 | Myers | 273/26 E |
| 3,948,517 | 4/1976 | Feiler | 273/26 E |
| 4,046,284 | 9/1977 | Samuelson | 273/29 R |
| 4,071,239 | 1/1978 | Ferguson | 273/26 E |
| 4,365,804 | 12/1982 | Melvin | 273/29 R |
| 4,865,319 | 9/1989 | Drazinakis | 273/26 E |

FOREIGN PATENT DOCUMENTS

| | | | |
|---|---|---|---|
| 489842 | 8/1938 | United Kingdom | 273/29 A |

*Primary Examiner*—Theatrice Brown

*Attorney, Agent, or Firm*—S. Michael Bender

[57] ABSTRACT

A new and improved tethered-ball, hitting practice apparatus is disclosed that includes a base member, a vertical support member connected to and supported by the base member, a tether-assembly-retaining member connected to and supported by the vertical support member, and a tether assembly connected to and supported by the tether-assembly-retaining member. The tether assembly includes a tether cord and a spindle for adjusting the tether cord length. The spindle stores and pays out the tether cord and permits a portion of the tether cord to hang freely from the apparatus. A connector is provided to connect the freely hanging tether cord portion to a ball. The tether-assembly-retaining member includes guide elements for guiding a portion of the tether cord from the spindle to the freely hanging tether cord portion. In addition, the tether-assembly-retaining member includes a hollow body portion having an open end and an orifice in a side portion of the hollow body portion. In this respect, the tether cord guide elements include the open end and the side orifice of the tether-assembly-retaining member. The vertical support member has an adjustable length. The ball can be connected to the freely hanging tether cord portion by either a rubber band or a strap having a loop and pile connector. In addition, combined ball holder and dispenser can be connected to the vertical support member.

6 Claims, 3 Drawing Sheets

TETHERED-BALL, HITTING PRACTICE APPARATUS

BACKGROUND OF THE INVENTION

1. Field of the Invention

The present invention relates generally to practice devices for practicing sports skills, and more particularly, to a tethered-ball practice device for practicing hitting skills in baseball, softball, and tennis.

2. Description of the Prior Art

Practice devices for practicing sports skills are well known in the art. More specifically, there are known tethered-ball practice devices for practicing hitting skills. For example, U.S. Pat. No. 3,626,502 of Well discloses a batting practice apparatus that includes a ball having a constant length tether secured to an upright stake. A spring device is used to absorb the shock of tethered balls that are hit and travel the full length of the constant length tether. The constant length tether is relatively long and can suffer entanglement and exposure to bad weather when the apparatus is not in use. No provision is made for easily adjusting the length of the tether or for storing the tether when not in use.

In U.S. Pat. No. 3,953,028 of Gowles, a ball is attached to a short, constant length tether which, in turn, is attached to a slide bushing that rides on a guide wire that spans two spaced apart support frames. To adjust the height of the tethered ball, each of the spaced apart frames must be adjusted. Having two support frames makes such a device relatively expensive in comparison with a device that has only one supporting device. Moreover, to adjust the distance that a tethered ball travels along the guide wire, the distance between the spaced apart frames must be adjusted. When not in use, the guide wire and constant length tether can suffer exposure to bad weather. No provision is made for easily adjusting the length of the tether cord.

Another tethered ball batting practice device is disclosed in U.S. Pat. No. 4,964,634 of Boyer in which a ball is secured to a two part tether. The largest part of the tether includes an inelastic cord. A small part of the tether is comprised of an elastic cord portion. With this device, a pitcher pitches the tethered ball to a batter, and once the hit tethered ball comes to rest, the pitcher must pick up the tethered ball to pitch it again. The need for a pitcher precludes a person getting batting practice when the person is alone. No provision is made for easily adjusting the length of the tether cord.

Aside from tethered-ball hitting practice devices, other hitting practice devices are disclosed in the prior art. For example, in U.S. Pat. No. 4,097,044 of Miniere, a baseball batting training apparatus includes a finger and a cam for automatically positioning a movable target for batting practice after each blow is delivered by a baseball bat. The movable target is an automobile tire casing, and, when hit, the tire casing rotates around a vertical pedestal before returning to its original position on the pedestal.

In U.S. Pat. No. 4,768,785 of Patterson, a batting training device includes an elongated, lightweight, tubular member that forms a longitudinal extension of the handle of the bat. In U.S. Pat. No. 5,002,274 of Bidema, a baseball batting practice device is disclosed which includes a substantially vertical frame which supports a flexible net material that receives and bounces back a batted ball back towards the batter. There is no connection between the flexible material and the batted ball.

Thus, while the foregoing body of prior art indicates it to be well known to use tethered ball devices to enable a person to obtain batting practice when alone, the provision of a simple, cost effective device is not contemplated that also provides good protection of the tether from bad weather and from tangling when the tether is not in use. Moreover, the prior art described above does not teach or suggest a simple, cost effective tethered ball hitting practice device that is easily adjusted vertically, that has means for easily adjusting the length of the tether cord, and that can be used to wind up the tether cord when the device is not being used.

The foregoing disadvantages are overcome by the unique tethered-ball, hitting practice apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved tethered-ball, hitting practice apparatus that includes a base member, a vertical support member connected to and supported by the base member, a tether-assembly-retaining member connected to and supported by the vertical support member, and a tether assembly connected to and supported by the tether-assembly-retaining member. The tether assembly includes a tether cord and a spindle for adjusting the tether cord length. The spindle stores and pays out the tether cord and permits a portion of the tether cord to hang freely from the apparatus. A connector is provided to connect the freely hanging tether cord portion to a ball. The tether-assembly-retaining member includes means for guiding a portion of the tether cord from the spindle to the freely hanging tether cord portion. Preferably, the tether-assembly-retaining member includes a hollow body portion having an open end and an orifice in a side portion of the hollow body portion. In this respect, the tether cord guide means include the open end and the side orifice of the tether-assembly-retaining member. The vertical support member has an adjustable length. The ball can be connected to the freely hanging tether cord portion by either a rubber band, a strap having a loop and pile connector, or other suitable means. In addition, a ball holder and dispenser can be connected to the vertical support member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal term of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved tethered-ball, hitting practice apparatus which has all of the advantages of the prior art and none of the disadvantages.

It is another object of the present invention to provide a new and improved tethered-ball, hitting practice apparatus which may be easily and efficiently manufactured and marketed.

It is a further object of the present invention to provide a new and improved tethered-ball, hitting practice apparatus which is of durable and reliable construction.

An even further object of the present invention is to provide a new and improved tethered-ball, hitting practice apparatus which is susceptible of a low cost of manufacture with regard to both materials and labor, and which accordingly is then susceptible of low prices of sale to the consuming public, thereby making such tethered-ball, hitting practice apparatus available to the buying public.

Still yet a further object of the present invention is to provide a new and improved tethered-ball, hitting practice apparatus that provides good protection of the tether from bad weather and from tangling when the tether is not in use.

Yet another object of the present invention is to provide a tethered-ball, hitting practice apparatus that is easily adjusted vertically.

Yet still another object of the present invention is to provide a tethered-ball, hitting practice apparatus that permits the ball to be released from its tether when hit thus enabling the batter to observe the trajectory of the ball during flight.

Still another object of the present invention is to provide a tethered-ball, practice hitting device which permits some players to practice fielding the ball while permitting a player to practice hitting the ball being tethered.

Still another object of the present invention is to provide a tethered-ball, hitting practice apparatus that includes means for easily adjusting the length of the tether cord, and that can be used to wind up the tether cord when the apparatus is not being used.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
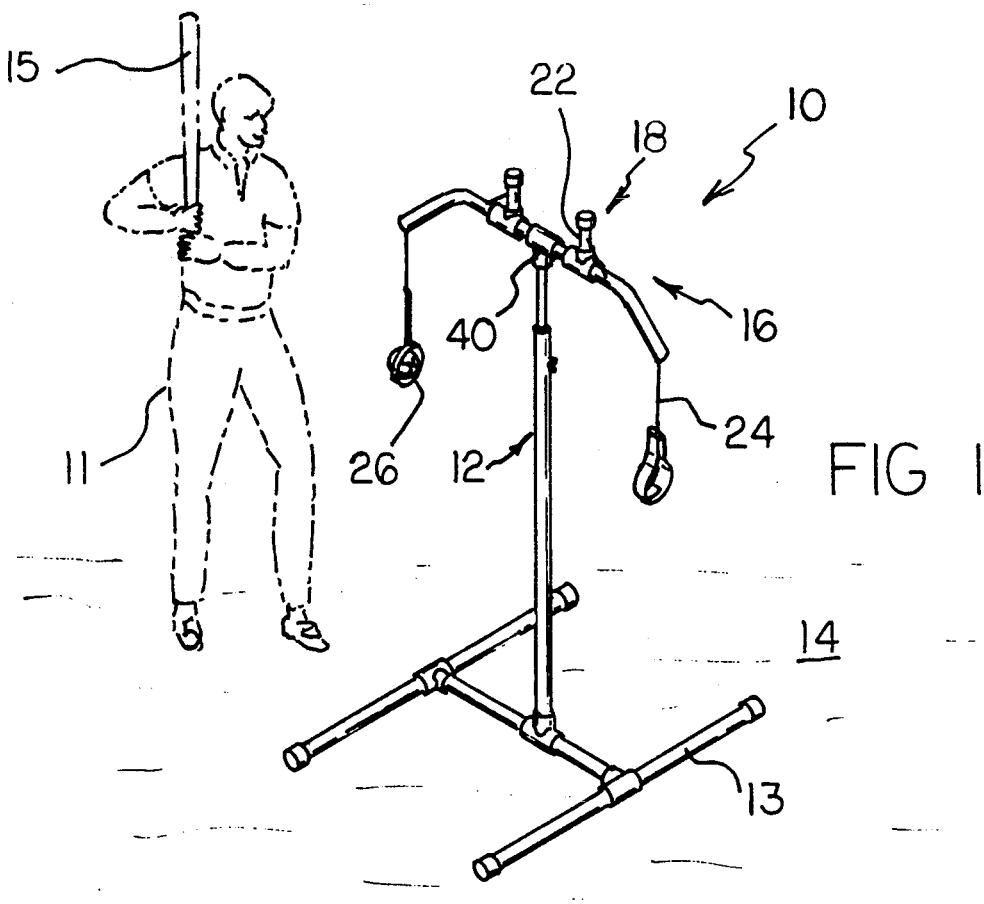
FIG. 1 is a perspective view showing a first preferred embodiment of the tethered-ball, hitting practice apparatus of the invention.

With reference to the drawings, a new and improved tethered-ball, hitting practice apparatus embodying the principles and concepts of the present invention will be described.

Turning initially to FIGS. 1–4, there is shown a first exemplary embodiment of the tethered-ball, hitting practice apparatus of the invention generally designated by reference numeral 10. In its preferred form, the tethered-ball, hitting practice apparatus 10 includes a vertical support member 12 supported by a horizontal floor surface 14, a tether-assembly-retaining member 16 connected to and supported by the vertical support member 12, and a tether assembly 18, connected to and supported by the tether-assembly-retaining member 16. The tether assembly 18 includes a tether cord 20, means 22 for adjusting tether cord length (shown as spindle 22), and means for connecting a freely hanging tether cord portion 24 to a ball 26 (may be a baseball or softball or the like). The means for connecting the free tether end to a ball 26 can be either a rubber band 28 or a strap preferably comprising a pair of sections 30, 32 suitably sewn or otherwise attached together at one end and adapted to be releasably attached together at their opposed other or distal ends by corresponding loop and pile connector elements such as sold under the VELCRO Registered Trademark, substantially as shown. By this arrangement, and in a manner believed apparent, rubber band 28 and/or straps 30, 32 are adapted to hold ball 26 at the end of tether cord portion 24; but release the ball when it is hit by a batter 11 swinging bat 15 thereby giving flight to the ball and simulating the normal hitting action of a practicing individual.

More specifically, the vertical support member 12 is supported by base member 13 which is supported by the floor surface 14. Alternatively, when the tethered-ball, hitting practice apparatus of the invention is used on soil, either the base member 13 could be used to support the vertical support member 12, or the vertical support member 12 could be driven directly into the ground.

The tether-assembly-retaining member 16 includes means for guiding a portion of the tether cord 20 from the spindle 22 to the freely hanging tether cord portion 24. Generally, the guiding means includes at least one guide member located between the spindle 22 and the freely hanging tether cord portion 24.

More specifically, the tether-assembly-retaining member 16 includes a hollow body portion 34 which has an open end 36 and an orifice 38 in a side portion of the hollow body portion 34; and the guiding means for the tether cord 20 is comprised of both the open end 36 and the side orifice 38 of the tether-assembly-retaining member 16.

Figure 2:
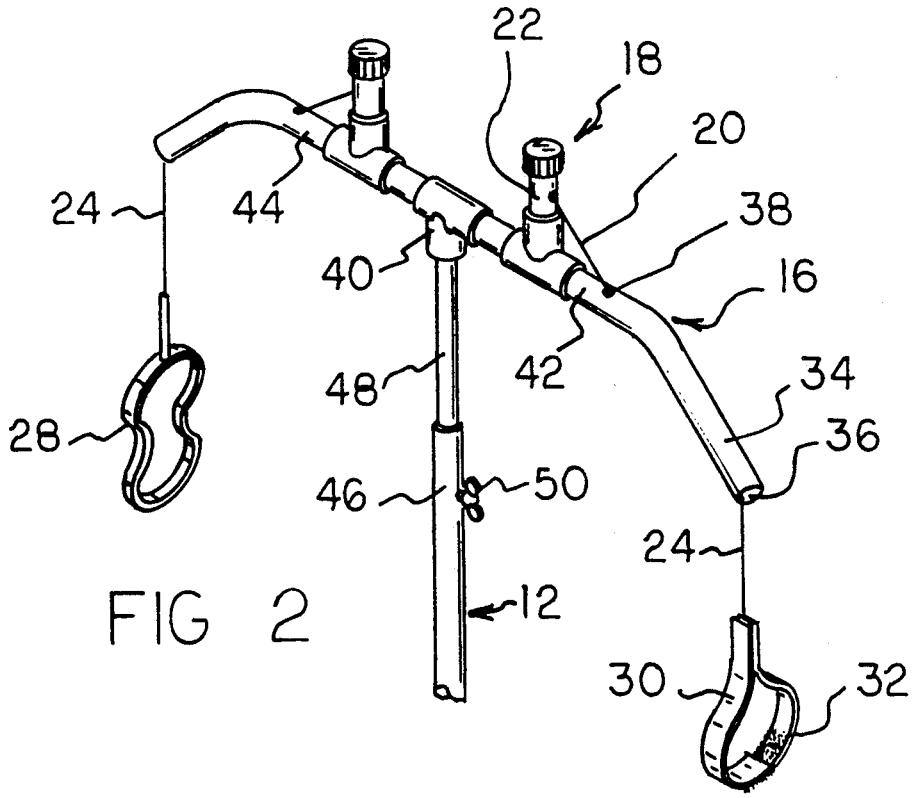
FIG. 2 is an enlarged perspective view of the top portion of the embodiment shown in FIG. 1.

More specifically, the embodiment of the tethered-ball, hitting practice apparatus 10 of the invention shown in FIGS. 1 and 2 includes a T-shaped connector 40 for connecting the tether-assembly-retaining member 16 to the vertical support member 12. Even more specifically, the tether-assembly-retaining member 16 includes two portions 42 and 44, such that, when the two portions 42 and 44 are connected to the T-shaped connector 40, which is connected to the vertical support member 12, a substantially T-shaped apparatus 10 is formed.

The vertical support member 12 includes an outer tubular portion 46 and an inner, telescoping tubular portion 48 for adjusting the vertical length of the vertical support member 12. A threaded hole is located in the outer tubular portion 46, and a threaded bolt 50 is used to lock an adjusted height of the inner tubular portion 48 with respect to the outer tubular portion 46.

Figure 3:
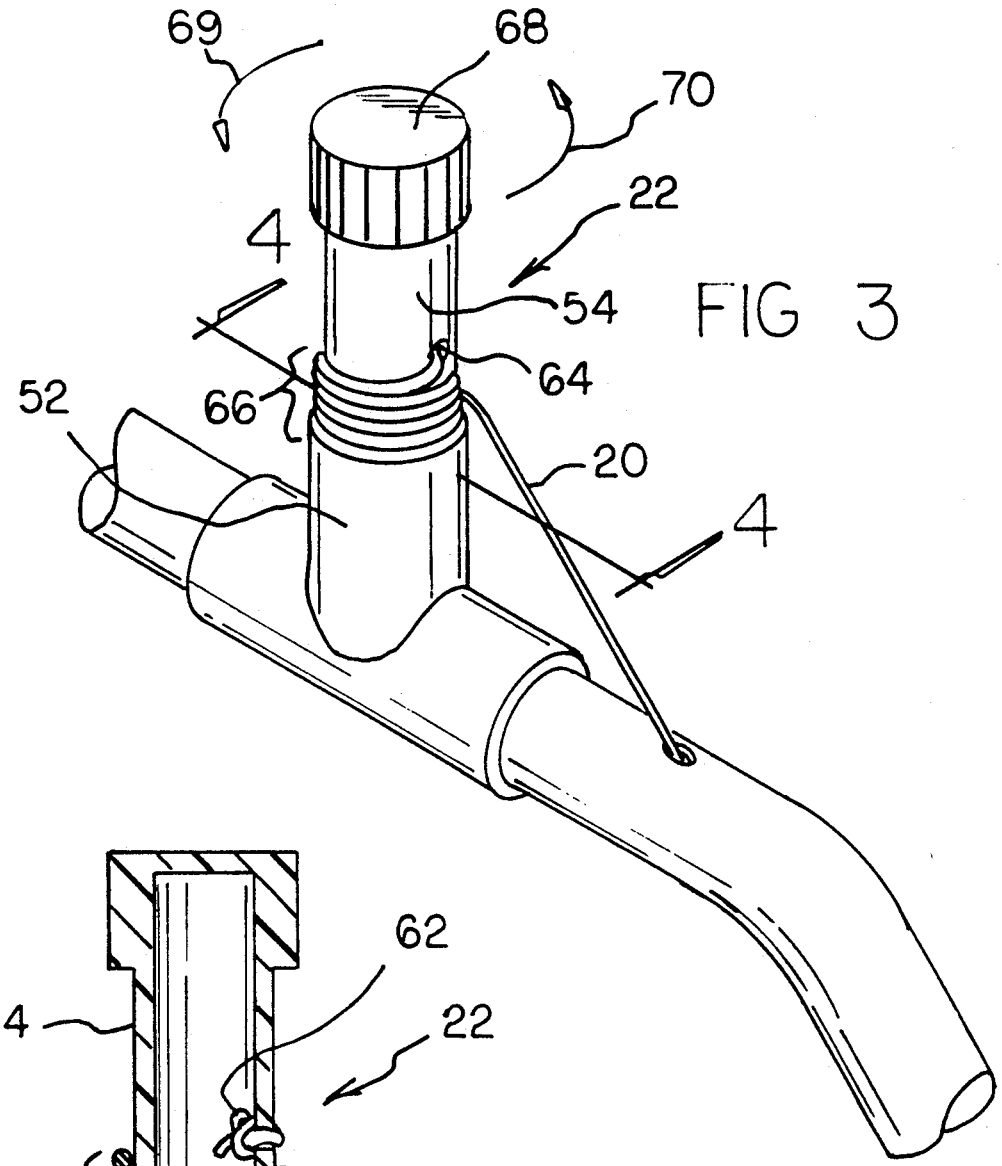
FIG. 3 is an enlarged perspective view of the spindle shown in FIGS. 1 and 2.
Figure 4:
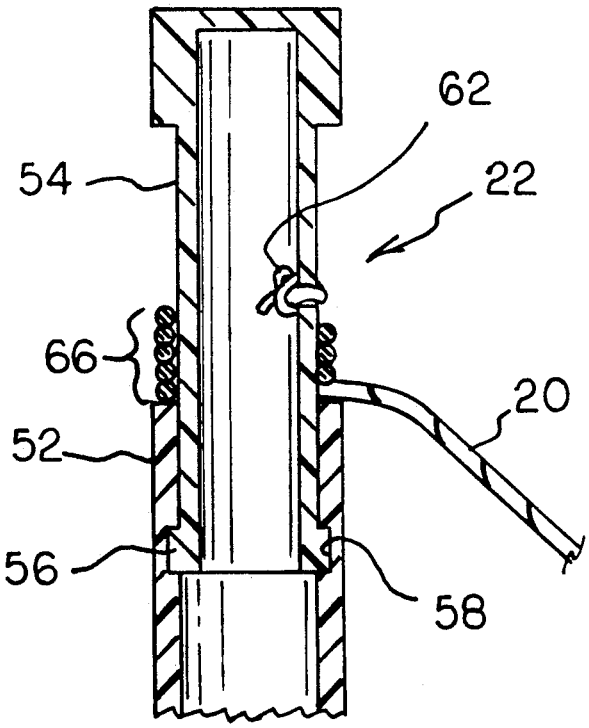
FIG. 4 is an enlarged cross-sectional view of the spindle shown in FIG. 3 taken along the line 4—4.

Structural components of spindle 22 are shown in greater detail in FIGS. 3 and 4. The spindle 22 includes an outer tubular member 52 and an inner tubular member 54. A flange 56 at the lower end of the inner tubular member 54 engages a complementary groove 58 in the outer tubular member 52 such that the inner tubular member 54 and the outer tubular member 52 are connected together. Moreover, the flange 56 and groove 58 connection permit the inner tubular member 54 to be rotated within the outer tubular member 52 with becoming disconnected from the outer tubular member 52.

A knotted end 62 of the tether cord 20 is located within the inner tubular member 54, and the remainder of the tether cord 20, having passed through an orifice 64 in the inner tubular member 54, is located outside the inner tubular member 54. A portion 66 of the tether cord 20 is wound around the outside of the inner tubular member 54. By a person grasping a knurled knob 68 and turning the knob 68 in one direction or the other (indicated by arrows 69 and 70), the length of the free tether end 24 of the tether cord 20 can be shortened or lengthened, respectively. That is, when the tether cord is shortened, more of the tether cord 20 is wound around the inner tubular member 54. Conversely, when the tether cord 20 is lengthened, less of the tether cord 20 is wound around the inner tubular member 54, and more of the tether cord 20 is payed out through the guide orifice 38 and the open end 36 in hollow body portion 34.

Thus, by adjusting the spindle 22, the height of the tethered ball 26, supported by either the rubber band 28 or the strap 30, can be adjusted. Moreover, by turning the spindle 22 a sufficient number of turns to shorten the payed out portion of the tether cord 20, the tether cord 20 can be shortened to the greatest extent possible so that the spindle 22 serves to store wound-up portions of the tether cord 20 on the outside of the inner tubular member 54 thereby protecting the tether cord 20 from the weather when the apparatus 10 is not in use.

More specifically, by turning the spindle 22 either counter-clockwise or clockwise, the tethered ball 26 can be adjusted to be in a high position, in a low position, or in a midway position with respect to the height of the tethered-ball, hitting practice apparatus 10 of the invention and the horizontal surface 13.

By appropriate adjustment of the height of the tethered ball 26 (either by turning the spindle 22 and/or by adjusting the height of the vertical member 12) and by appropriate stance of a player 11 holding a bat 15, the tethered-ball, hitting practice apparatus 10 of the invention can be used to provide balls at locations to represent pitched balls that are either low, waist-high, or high or inside, over the plate, or outside or combinations thereof. In addition, the rotational position of the spindle 22 and/or the height of the vertical member 12 can be adjusted to provide longer or shorter arcs for the ball to follow once it is hit by the player.

The tethered-ball, hitting practice apparatus 10 of the invention can be used by either right-handed or left-handed batters.

In addition, the tethered-ball, hitting practice apparatus 10 of the invention can also be used for practicing tennis swings or strokes. In such a case a tennis ball would be secured by either the rubber band 28 or the strap 30.

Moreover, by using the tethered-ball, hitting practice apparatus 10 of the invention, the tethered ball 26 can be hit in a manner that would provide ground balls, line drives, fly balls, or pop ups. In addition, the tethered ball 26 can be swung on the free tether end 24 of the tether cord 20 to simulate straight or curve balls from either right-handed or left-handed pitchers.

It will be appreciated that in accordance with the invention, and as already mentioned, the means for connecting tether cord end portion 24 to ball 26 (e.g. baseball, softball, tennis ball or the like) is adapted to release the ball upon being hit by a swinging implement such as bat 15 (or a tennis racket, etc.) so that the trajectory of the hit ball may be observed by the hitter. This gives the hitter immediate visual feedback of the ball or other hit object in flight enabling the hitter to adjust his/her swing and rapidly improve his/her hitting skills. Moreover, by releasably supporting ball 26 in connecting means 28, or 30,32; so that it will be given flight when hit enables one or more "fielders" remotely positioned with respect to apparatus 10 to practice their defensive or fielding skills substantially simultaneously when another is taking his/her turn as a batter practicing "hitting" skills.

Figure 5:
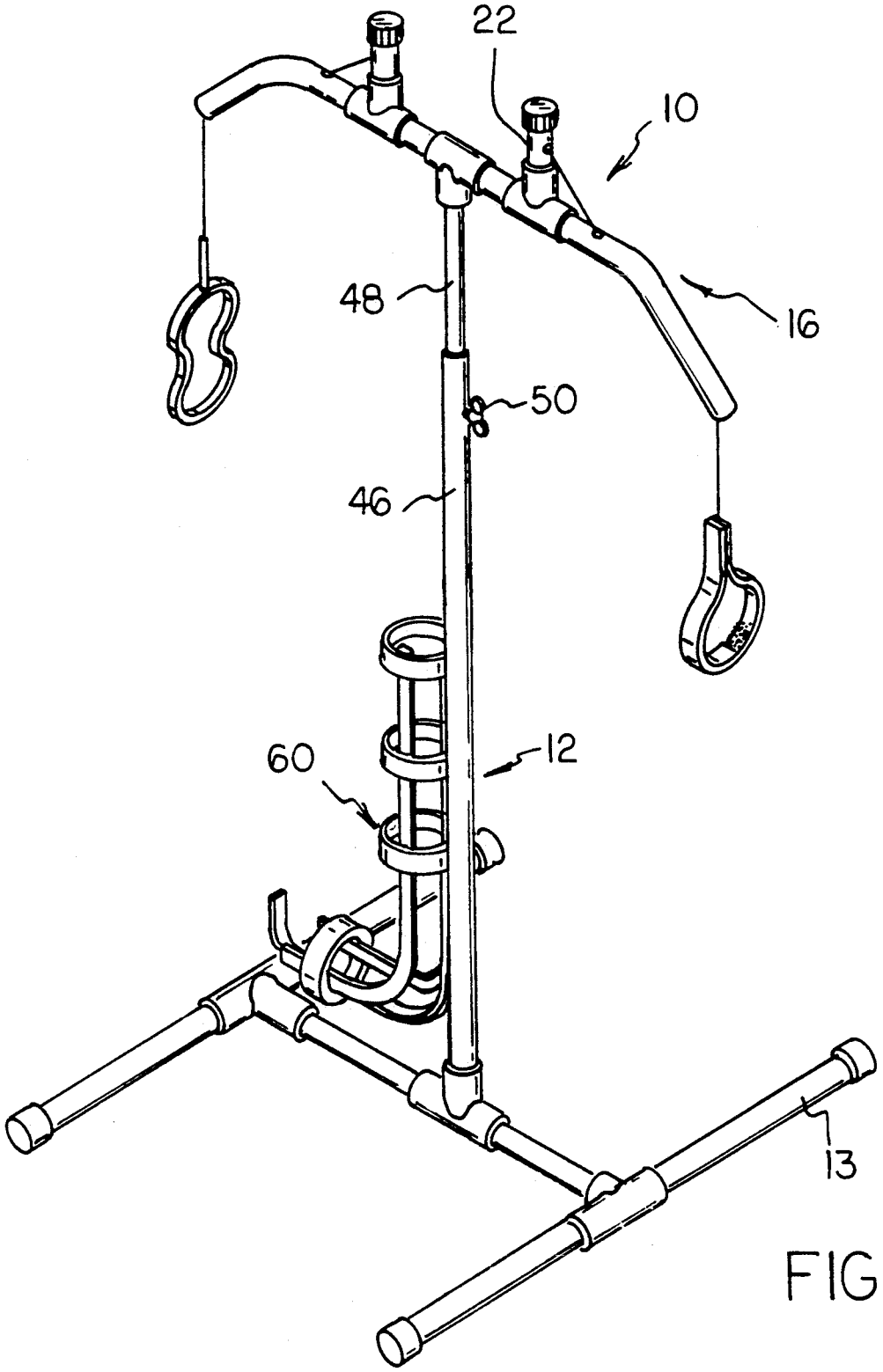
FIG. 5 is a perspective view showing a second preferred embodiment of the tethered-ball, hitting practice apparatus of the invention which includes a combined ball holder and dispenser.

Turning to FIG. 5, there is shown a second preferred embodiment of the present invention wherein like reference numerals represent like parts in other figures. More specifically, in the embodiment shown in FIG. 5, the tethered-ball, hitting practice apparatus 10 of the invention further includes a combined ball holder and dispenser 60 which is connected to the vertical support member 12.

The tether can be made from any suitable rope of cord. Weather-resistant nylon cord may be preferred. The major structural elements of the tethered-ball, hitting practice apparatus of the invention (such as the base, the vertical support member, and the tether-assembly-retaining members) can be made from standard hollow metal or plastic pipes or tubes; and they can be connected together with standard couplings.

It is apparent from the above that the present invention accomplishes all of the objects set forth by providing a new and improved tethered-ball, hitting practice apparatus that is low in cost, relatively simple in design and operation, and which may advantageously be used for practicing baseball, softball, tennis, or the like.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved tethered-ball, hitting practice apparatus supported on a horizontal surface, comprising:

a base member supported by the horizontal surface;

a vertical support member connected to and supported by said base member, said vertical support including means for adjusting the vertical length of said vertical support;

a tether-assembly-retaining member connected to and supported by said vertical support member;

a tether assembly, connected to and supported by said tether-assembly-retaining member, wherein said tether assembly includes a tether cord having first and second ends, means for adjusting tether cord length, said tether cord adjustment means permitting a portion of said tether cord including said second end thereof to hang freely from the apparatus, and means for connecting said freely hanging second end of said tether cord portion to a ball;

wherein said tether-assembly-retaining member includes means for guiding a portion of said tether cord from said tether cord adjustment means to said freely hanging tether cord portion;

wherein said means for adjusting tether cord length comprises a rotatable spindle mounted for rotation on said vertical support, said tether cord first end being connected to said rotatable spindle; and wherein said tether-assembly-retaining member further includes a hollow body portion having an open end and an orifice in a side portion of the hollow body portion, and wherein said guiding means is comprised of the open end and the side orifice of said tether-assembly-retaining member, and wherein said tether cord extends from said rotatable spindle through said side orifice such that manual rotation of said spindle is adapted to wrap said tether cord about said spindle thereby raising and lowering said tether cord through said retaining member to selectively adjust said freely hanging second end thereof.

2. The apparatus described in claim 1, further including:

a T-shaped connector for connecting said tether-assembly-retaining member to said vertical support;

wherein said tether-assembly-retaining member includes two portions, such that, when said two portions are connected to said T-shaped connector, which is connected to said vertical support, a substantially T-shaped apparatus is formed, wherein said means for adjusting and said retaining member form part of said T-shaped connector.

3. The apparatus as described in claim 2 wherein said T-connector comprises a pair of oppositely extending horizontal arms, and each said arms supports a separate tether cord, retaining member and corresponding tether cord adjustment means.

4. The apparatus described in claim 1 wherein said spindle includes:

an outer tubular member connected to said tether-assembly-retaining member and including a groove in the inside surface of the outer tubular member;

an inner tubular member telescopically received by said outer tubular member and including a flange at a lower end of the inner tubular member, such that said flange engages said groove in said outer tubular member, whereby said inner tubular member and said outer tubular member are connected together, wherein said flange and groove connection permits said inner tubular member to be rotated within said outer tubular member without becoming disconnected from the outer tubular member;

wherein one end of said tether cord is connected to said inner tubular member such that the free tether end of said tether cord is shortened or lengthened when said inner tubular member is rotated within said outer tubular member.

5. The apparatus of claim 4 wherein said means for connecting said freely hanging tether end portion to a ball is releasable such that said ball is adapted to put in flight when hit by a swinging implement.

6. The apparatus of claim 5 wherein said flight simulates the normal trajectory of a ball hit by said swinging implement.

* * * * *